United States Patent [19]

Rundo

[11] Patent Number: 4,754,585

[45] Date of Patent: Jul. 5, 1988

[54] SEAL AND COMPRESSION CLIP FOR WINDOW GLAZING

[75] Inventor: John R. Rundo, Strongsville, Ohio

[73] Assignee: The B. F. Goodrich Company, Akron, Ohio

[21] Appl. No.: 926,935

[22] Filed: Nov. 4, 1986

[51] Int. Cl.[4] ..... E04B 3/26

[52] U.S. Cl. ..... 52/202; 52/766; 52/767

[58] Field of Search ..... 52/766, 767, 768, 769, 52/202, 203, 127.6, 127.8, 397; 248/311.4, 231.4

[56] References Cited

U.S. PATENT DOCUMENTS

| | | | |
|---|---|---|---|
| 1,024,071 | 6/1912 | Le Page | 248/231.4 |
| 1,745,652 | 2/1930 | Watson . | |
| 2,454,975 | 11/1948 | Pelley | 52/766 |
| 2,595,927 | 5/1952 | Chapin | 52/767 |
| 2,781,561 | 2/1957 | Gifford | 52/398 |
| 3,468,516 | 9/1969 | Jounot | 52/769 |
| 3,824,753 | 8/1974 | Anderson . | |
| 3,971,178 | 8/1976 | Mazzoni et al. . | |
| 4,055,923 | 11/1977 | Biebuyck | 52/397 |
| 4,121,394 | 10/1978 | Brooks | 52/203 |
| 4,139,971 | 2/1979 | Kimura . | |
| 4,156,988 | 6/1979 | Grover | 52/397 |
| 4,235,056 | 11/1980 | Griffin | 52/397 |
| 4,351,137 | 9/1982 | Enyart | 52/202 |
| 4,431,691 | 2/1984 | Greenlee . | |
| 4,561,223 | 12/1985 | Gold et al. . | |
| 4,566,233 | 1/1986 | Naka . | |
| 4,625,479 | 12/1986 | Giguere | 52/766 |

FOREIGN PATENT DOCUMENTS

| | | | |
|---|---|---|---|
| 38935 | 8/1972 | Australia | 52/397 |
| 2263990 | 7/1973 | Fed. Rep. of Germany | 52/397 |
| 1052020 | 12/1966 | United Kingdom | 52/766 |
| 1189518 | 4/1970 | United Kingdom . | |

*Primary Examiner*—Henry E. Raduazo

*Attorney, Agent, or Firm*—Gregory N. Clements; Nestor W. Shust

[57] ABSTRACT

A system for creating a dead air space between an existing window and window frame, and a piece of glazing is described. The system includes a sealing strip for spacing the piece of glazing away from the existing window and to seal the space there between when a sealing strip is properly compressed. The strip is compressed by employing a plurality of compression clips, each clip having an anchor part for mounting the clip on the window frame, a contact part spaced away from and movable with respect to said anchor part for compressing the piece of glazing against the sealing strip, and an adjustment part for adjusting the space between the anchor part and the contact part. The compression part further includes a compression gasket mounted between the piece of glazing and the compression clips.

14 Claims, 5 Drawing Sheets

FIG. 1
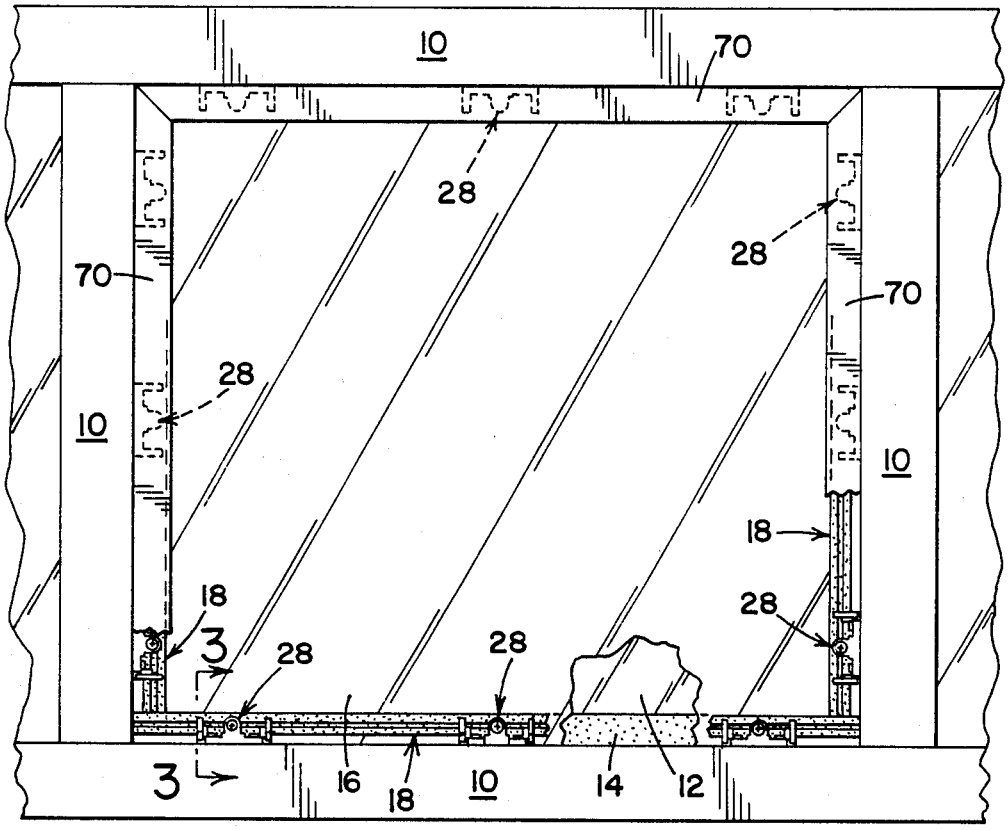
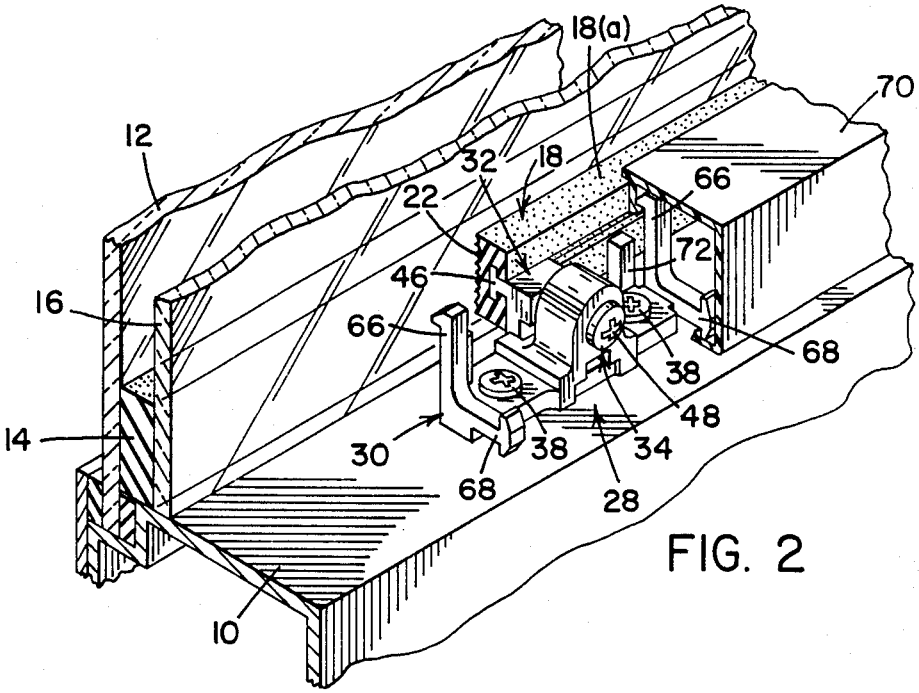
FIG. 2

SEAL AND COMPRESSION CLIP FOR WINDOW GLAZING

BACKGROUND OF THE INVENTION (1) Field of the Invention

The present invention pertains to a secondary window glazing to be mounted as an add-on insulation system adjacent the interior of an existing window, thereby providing dead air space between the two pieces of glazing. In particular, the present invention pertains to a seal and compression clip for mounting and retaining the secondary glazing juxtaposed, but spaced away from, the original existing window glazing. More particularly, the seal and compression clip is designed to be secured to the existing window frame and formed so that it is capable of applying a compression force against the secondary glazing in an adjustable manner.

(2) Prior Art

As natural energy sources are depleted, the cost of heating and cooling a residential or commercial building with electricity, oil or gas has become more expensive. As a direct result of the increasing cost of heating and cooling, insulating residential and commercial buildings has become more important. However, many residential and commercial buildings were constructed during a time in which the energy cost for heating and cooling was relatively minor. In this era, there was no real impetus to employ anything other than a single window glazing during construction. Therefore, when the cost of heating and cooling increased, it became cost effective to add-on a secondary glazing adjacent existing windows, thereby creating an insulating dead air space between the original window and the secondary glazing.

One way to obtain an insulated dead air space between an original window and a secondary glazing is to mount the secondary glazing on the inside of the existing window. Many prior art documents teach a window structure in which a piece of secondary glazing is mounted inside and juxtaposed the original window to create an insulating dead air space there between. Exemplary of such documents are the following U.S. patents.

U.S. Pat. No. 4,431,691 to Greenlee (assigned to Tremco Inc., the assignee of the present invention) discloses a sealant and spacer strip for spacing two windows from one another. The sealant and spacer strip, when compressed by the two windows, forms a dead air space.

U.S. Pat. Nos. 3,824,753 to Anderson and 3,971,178 to Mazzoni et al, and Great Britain Pat. No. 1,189,518 to Bayer disclose an add-on secondary window spaced apart from an existing window by a peripheral spacer. The peripheral spacer is placed in compression between the windows by a retainer means including one or more screws which act to secure the retainer means to the existing window frame. The retainer means and existing screws are easily visible and detract from the aesthetic appearance of the window. Moreover, none of these references disclose or suggest a retainer means which is adjustable to vary the amount of compressive force applied to the secondary window.

One of the chief aims of the present invention is to provide a compression clip designed to apply pressure to the secondary glazing in order to achieve the proper sealing between the secondary glazing, the existing window and the window sash.

Another aspect of the present invention is to provide a compression clip which is adjustable, i.e., the compression force can be varied without detaching the clip from the existing window frame.

Another aim of the present invention is to provide an aesthetically pleasing device capable of covering all compression clips to present an overall pleasing appearance.

Another aspect of the present invention is to provide an adjustable compression clip which does not make holes in the window frame or sash to securely anchor the clip.

SUMMARY OF THE INVENTION

The present invention relates to positioning a piece of glazing interiorly of and adjacent to the original window glazing. A sealing strip made of rubber, for example, is positioned therebetween. The sealing strip may be held in position around the periphery of both the original glazing and the secondary glazing by means of an adhesive, nails or other fastening means, for example.

The secondary glazing is compressed against the sealing strip by means of a compression clip which includes anchoring means to firmly anchor the clip to the window sash, contact means to contact the secondary glazing and compress it against the sealing strip, and adjustment means for varying the compression force applied by the contact means against the secondary glazing. Preferably, a compression gasket is employed continuously about the periphery of the secondary glazing. The contact means then compresses the gasket which in turn compresses the secondary glazing against the sealing strip.

In the broadest sense, the present invention comprises a compression or retaining clip for compressing a piece of glazing against a sealing strip, the compression clip including anchoring means for firmly anchoring the clip against the window sash; contact means associated with the anchoring means for contacting the secondary glazing; and adjustment means for adjusting the distance between the contact means and the anchoring means, thereby compressing the glazing against the sealing strip to create dead air space between the existing window and the secondary glazing.

Optionally, the present invention includes the combination of a compression clip having a projection or groove incorporated with the contact means of the clip, and a compression gasket having a corresponding groove or projection designed to mate with the projection or groove, respectively, of the clip.

Optionally, an interlocking cover strip may also be provided to cover all the compression clips, thus presenting an overall pleasing, aesthetic appearance.

BRIEF DESCRIPTION OF THE DRAWINGS

Other aims and aspects of the present invention will become apparent upon reading the following detailed description and upon reference to the drawings, in which:

FIG. 1 is a fragmentary frontal view of the secondary glazing system of the present invention;

FIG. 2 is a fragmentary, perspective, enlarged view of the glazing system particularly illustrating the compression gasket, compression clip, and mating cover strip;

DETAILED DESCRIPTION OF THE PREFERRED EMBODIMENTS

Figure 3:
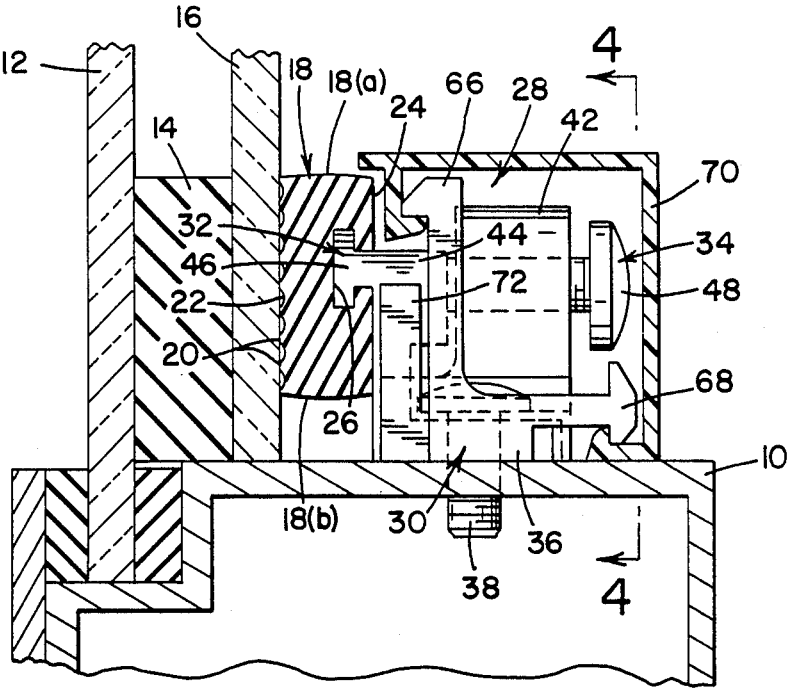
FIG. 3 is a fragmentary, enlarged, cross-sectional side view taken along Line 3—3 of FIG. 1 of the components of the secondary glazing system, including the compression clip, compression gasket (in compression), and cover strip.

Turning first to FIG. 1, there is shown the secondary glazing system of the present invention properly positioned within a window frame of an existing window. In particular, reference numeral 10 indicates an existing window frame which may be formed of wood, metal, marble, or the like, or a combination of these, as is conventionally known in residential or commercial construction. Mounted within the window frame 10 is an existing single piece of glazing or glass 12, which may be plain plate glass, bronze or copper tinted glass, or the like.

To make the secondary glazing system of the present invention, a sealing strip or tape 14 is positioned adjacent the periphery of the inside of the existing window 12 as is indicated, in part, in FIGS. 1 and 2. The sealing strip or tape 14 may be made from any insulating type material such as closed cell foam rubber, or a foam plastic, a formable or shapable sealing agent, or the like. Generally, any type of material will suffice for the sealing tape or strip 14 so long as the material is capable of forming a hermetic seal between the existing window 12 and any solid plate-like object, thereby creating a dead air space between the solid plate-like object and the existing single glazing 12.

Preferably, the solid plate-like material is a secondary piece of single glazing or glass 16 which is the same type of window glazing or glass as the existing window 12. However, the secondary glazing 16 could also be a type of glass or glazing different from that of the existing window 12.

In order to adequately compress the secondary glazing 16 against the sealing tape or strip 14, a compression gasket 18 is positioned against the outer periphery of the secondary glazing 16 on the surface facing the inside of the building. The compression gasket 18 may be formed of any material capable of being compressed against the secondary glazing 16 and capable of transferring any compressive forces applied against it to the secondary glazing, in a substantially uniform manner. The compressive gasket 18 can be formed from a moderately pliable rubber, for example. Although rubber is the preferred material, any gasket type material may be employed. Rubber is preferred because condensation that may develop on the secondary glazing would not harm the gasket, nor support mold or mildew growth in an extensive manner. Additionally, rubber is a relatively inexpensive material and can easily be form molded to accommodate any size glazing desired.

Figure 6:
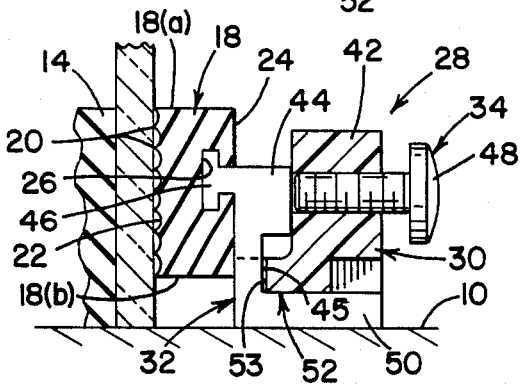
FIG. 6 is a fragmentary, enlarged, cross-sectional side view similar to FIG. 5 with the compression clip and compression gasket being in a relaxed state (not under compression)

As shown in FIGS. 3 and 6, the compression gasket 18 may include a series of ridges 20 on the face 22 designed to contact the secondary glazing 16. The series of ridges 20 aid in gripping the secondary glazing so that when compression forces are applied against the compression gasket 18, it will not slide or shift on the secondary glazing 16. The opposite face 24 of the compression gasket 18, against which the compression forces are applied, may be formed with one or more grooves or projections 26; the purposes of which will be fully explained later. Although the compression gasket 18 may take any shape, the preferred cross-sectional shape would be rectangular, thereby providing two faces 22 and 24 for the purposes explained above.

In order to apply compressive forces against the compression gasket 18, a plurality of compression clips 28 are employed as shown in FIG. 1. Although the number of compression clips 28 employed to adequately seal the secondary glazing in such a manner as to create a dead air space between the existing window and the secondary glazing, may be placed 12 inches apart along the sides of the secondary glazing or glass with a minimum of 4 clips per side being preferred. The actual number of compression clips 28 employed will, however, be primarily determined by employing that number necessary to provide an adequate compressive force against the compression gasket 18 to retain the secondary glazing 16 in compression against the sealing tape or strip 14 to create a dead air space between the existing window 12 and the secondary glazing 16.

Figure 7:
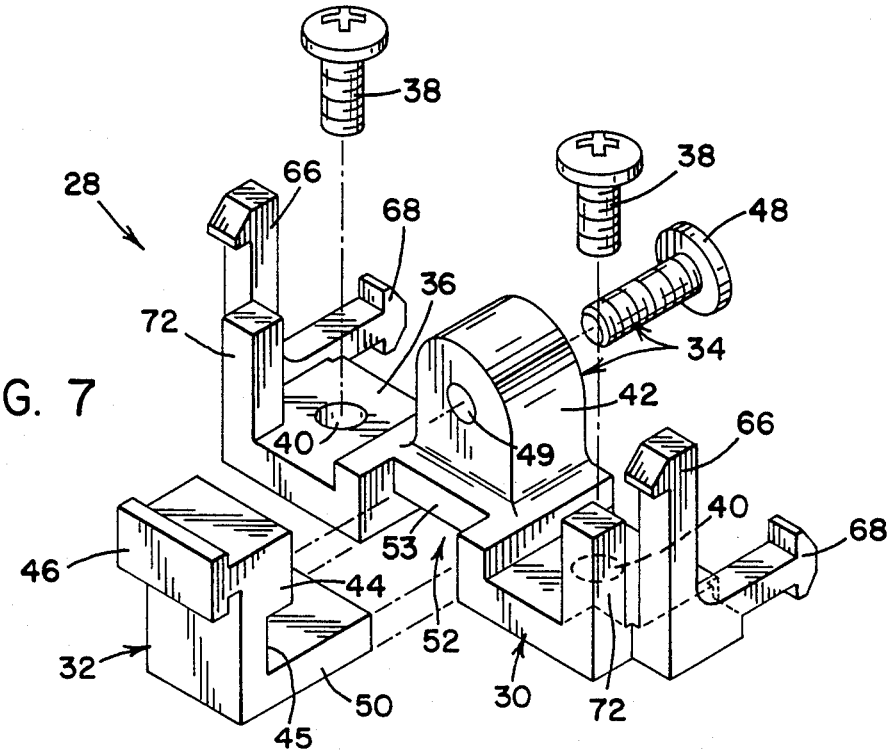
FIG. 7 is an enlarged, exploded, perspective view of a compression clip.

The compression clip 28, as shown in FIG. 7, generally comprises three components consisting of an anchor means 30, a contact means 32, and an adjustment means 34. The anchor means 30 secures at least a portion of the adjustment means 34 thereto in a manner that permits the adjustment means to apply force to the contact means 32. The anchor means 30 also secures the contact means 32 in a manner that permits at least a portion of the contact means to shift with respect to the anchor means.

The three components of the compression clip 28 may be formed of metal such as aluminum, bronze, copper, stainless steel, or the like. Additionally, the compression clip may also be made from plastics such as polyethylene, polyvinylchloride, acrylonitrile-butadiene-styrene, or the like. Of course, the three components may be made from different materials. For example, the anchor means 30 and contact means 32 may be made from polyethylene plastic, while the adjustment means 34 is made from aluminum.

The anchor means 30 comprises a plate-like base 36 designed to be secured to an existing window frame 10 in any conventional manner. For example, the plate-like base 36 may be secured to the existing window frame by means of two or more screws 38 which extend through a like number of holes 40 in the plate-like base 36. As illustrated in FIG. 7, the plate-like base 36 is integrally formed with a portion of the adjustment means 34 which consists of a perpendicularly projecting wall member 42.

Also projecting perpendicular from the plate-like base 36 is the contact means 32 which may or may not be integrally formed with the plate-like base 36. The contact means 32 includes a perpendicularly projecting wall member 44 with a special shaped projection or groove 46 designed to mate with the corresponding groove or projection 26, respectively, in the compression gasket 18. In other words, if the face 24 of the compression gasket 18 includes a groove formed therein, then the wall member 44 of the contact means 32 would include a corresponding projection shaped so as to be received by the groove, and vice versa.

Figure 4:
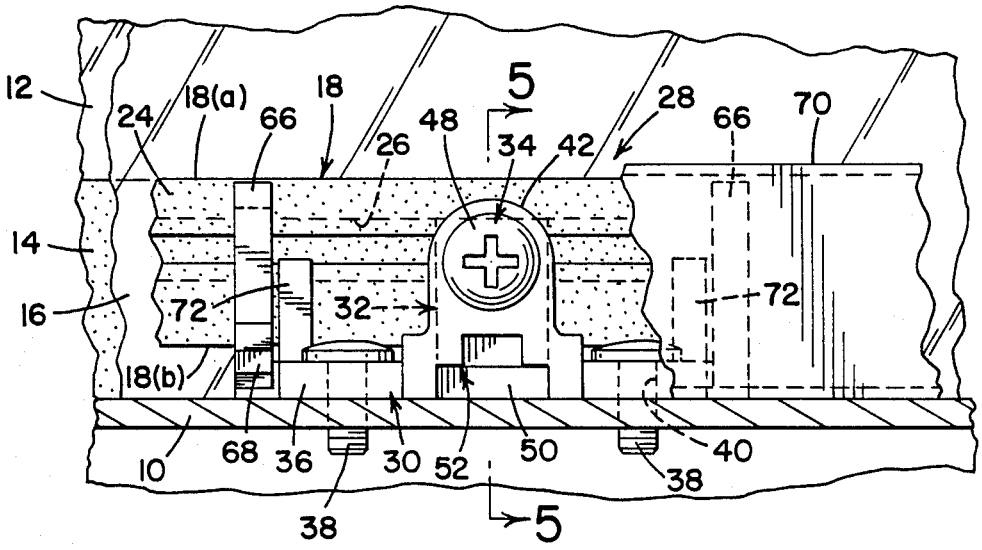
FIG. 4 is a fragmentary, enlarged, frontal view taken along Line 4—4 of FIG. 3 of a portion of the secondary glazing system.

The shape of the wall member 44 of the contact means 32 will depend upon the type of adjustment means employed. As illustrated in FIG. 7, the adjustment means 34 includes not only the previously mentioned wall member 42, but a set screw 48 designed to impact upon the wall member 44, illustrated in FIG. 7, of the contact means 32. Preferably, the set screw 48 is the self threading type. When the adjustment means 34 is a set screw, the wall member 42 includes a bore 49 which is slightly smaller in diameter than the set screw so as to provide a good fit. The wall member 44 in the FIG. 7 embodiment includes a perpendicular leg 50 such that the contact means 32 is generally L-shaped with a projection extending therefrom. The leg 50 is designed to slide within a recessed aperture 52 formed in the plate-like base 36 of the anchor means 30, as clearly shown in FIGS. 4 and 7. In this manner, when the set screw 48 is rotated into the wall member 42 of the adjustment means 34, the perpendicular leg 50, which is integral with the wall member 44, slides outwardly from within the recessed aperture 52.

FIG. 6 illustrates the compression clip 28 and compression gasket 18 in the relaxed position, i.e., the set screw 48 does not bear against the wall member 44 of the contact means 32. Moreover, a small component 45 of the wall member 44 is in contact with or adjacent to a small wall section 53, which forms in-part a segment of the recessed aperture 52.

Figure 5:
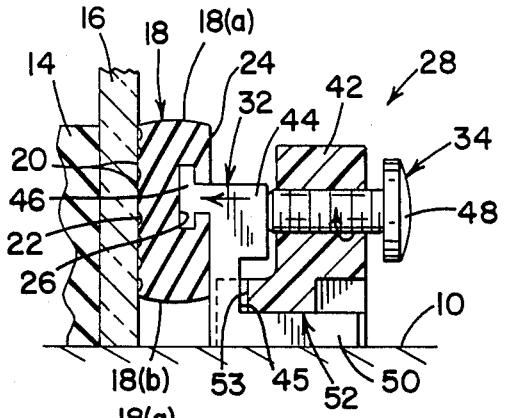
FIG. 5 is a fragmentary, enlarged, cross-sectional side view taken along Line 5—5 of FIG. 4 of the clip and the compression gasket, in compression.

On the other hand, FIG. 5 illustrates the compression clip 28 and the compression gasket 18 in the compressed position, i.e., the set screw 48 is in contact with the wall member 44. Furthermore, the small component 45 of wall member 44 is spaced away from the wall section 53. Additionally, the compression gasket 18 is compressed to the extent that the ridges 20 are flatter and less pronounced, while the upper and lower surfaces 18(*a*) and 18(*b*) of the gasket 18 are more rounded.

Figure 8:
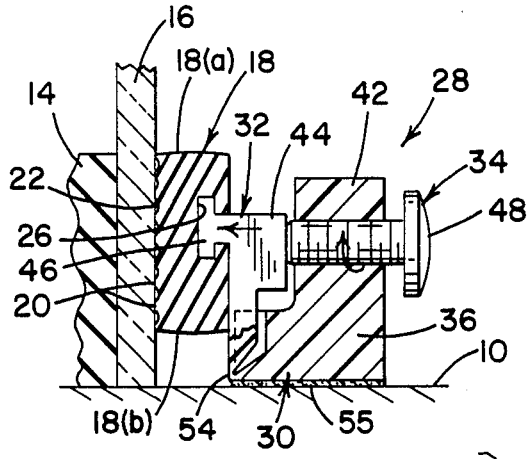
FIG. 8 is a fragmentary, enlarged, cross-sectional side view of another embodiment of the compression clip.
Figure 9:
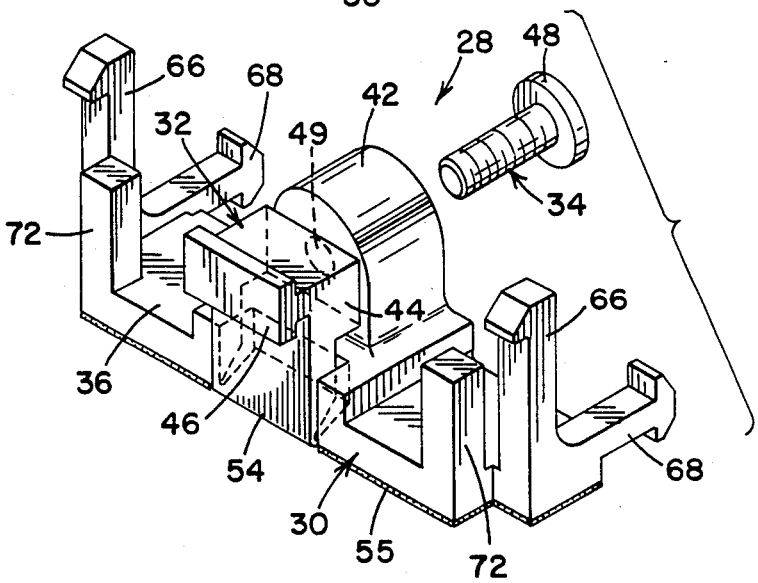
FIG. 9 is an enlarged, exploded, perspective view of the compression clip of FIG. 8.

In another embodiment of the compression clip 28, the wall member 44 of the contact means 32 is integrally formed with the plate-like base 36, as illustrated in FIGS. 8 and 9. The juncture of the wall member 44 and plate-like base 36 includes a thin component 54 which is substantially thinner than the remainder of the wall member 44. The thin component 54 permits the wall member 44 to move or flex away from the wall member 42 in a hinge-type action revolving around the thin component 54.

In this embodiment, the plate-like base 36 of the anchor means 30 is secured to the window frame 10 by means of an adhesive layer 55. The adhesive layer 55 is applied to the entire bottom surface of the plate-like base 36 particularly since this embodiment does not include a recessed aperture.

In operation of the FIGS. 8 and 9 embodiment, the sealing strip 14 and secondary glazing 16 are mounted in position as previously described. The compression gasket 18 is then attached to one or more compression clips 28 by means of the corresponding groove 26 and mating projection 46. Each compression clip 28 is then secured to the window frame 10 by the adhesive layer 55. To compress the compression gasket 18 against the secondary glazing 16, the set screw 48 is rotated clockwise, causing the set screw to abut against the wall member 44. Continued rotation of the set screw 48 pivots the wall member 44 about the hinge created by the thin component 54, thus driving wall member 44 toward the compression gasket 18.

Figure 10:
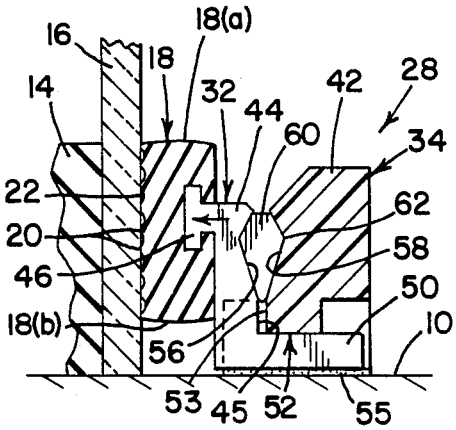
FIG. 10 is a fragmentary, enlarged, cross-sectional side view of another embodiment of the compression clip.
Figure 11:
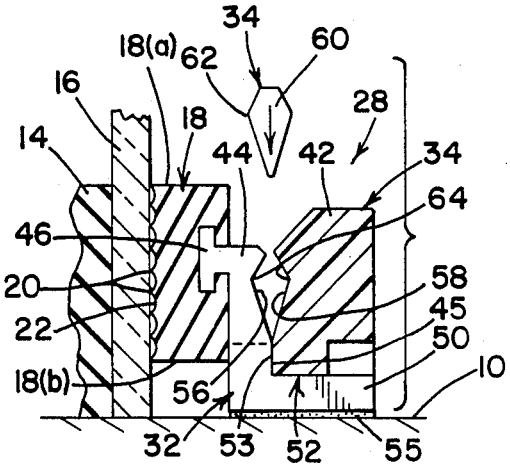
FIG. 11 is a fragmentary, enlarged, exploded, cross-sectional side view of the compression clip of FIG. 10.
Figure 12:
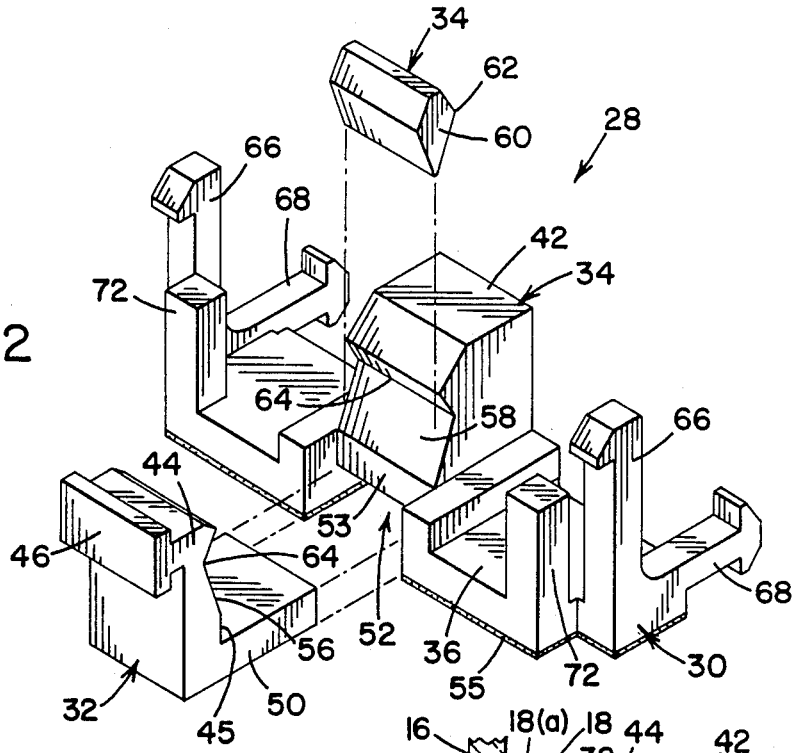
FIG. 12 is an enlarged, exploded, perspective view of the compression clip in FIG. 10.

In the embodiment illustrated in FIGS. 10–12, the wall member 44 of the contact means 32 and the wall member 42 of the adjustment means 34, include opposed enantiomorphic like faces 56 and 58 designed to receive a wedge 60. The wedge 60 may be any wedge-type shape so long as the portion 62 having the largest width fits within a corresponding tapered groove 64 formed in both faces 56 and 58 thereby locking the wedge 60 within the tapered grooves 64.

The contact means 32 in the FIGS. 10–12 embodiment is separate and independent from the remainder of the compression clip 28. The contact means 32 in this embodiment is similar to that illustrated in FIG. 7, i.e. the perpendicular leg 50 slides within recessed aperture 52. In order to permit the perpendicular leg 50 to slide within the recessed aperture, the adhesive layer 55 covers the bottom surface of the plate-like base 36, but does not cover the bottom surface of the adjustment means 34, nor the bottom surface of the contact means 32.

In operation of the embodiment covered by FIGS. 10–12, the sealing strip 14, secondary glazing 16 and compression gasket 18 are properly positioned as previously explained. Each compression clip 28 is secured to the window frame 10 by the adhesive layer 55. As illustrated in FIG. 11, the compression clip 28 and compression gasket 18 are in the relaxed, uncompressed state, i.e., the wedge 60 has not been inserted between the faces 56 and 58, and the small component 45 of wall member 44 is adjacent to, or in contact with, the small wall section 53 of the wall member 42. In order to compress the compression gasket 18 a predetermined amount, a proper size wedge 60 is selected and inserted between faces 56 and 58, as illustrated in FIG. 10. Insertion of wedge 60 between the faces 56 and 58 drives the contact member 32 away from wall member 42 and into the compression gasket 18. In the compressed state, the small component 45 of wall member 44 is spaced away from the small wall section 53 of wall member 42.

If an adhesive is employed to anchor the plate-like base 36 and a wedge 60 is employed as the adjustment means 34, it would be possible to install the secondary glazing system 16 without the use of conventional tools.

Figure 13:
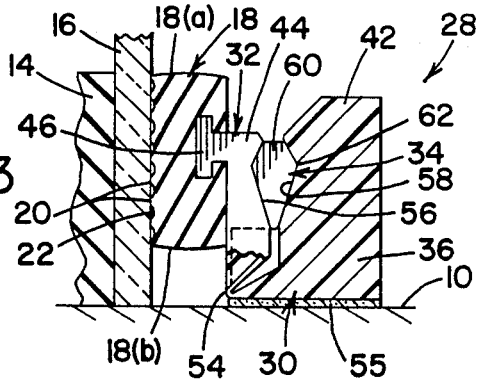
FIG. 13 is a fragmentary, enlarged, cross-sectional side view of another embodiment of the compression clip.
Figure 14:
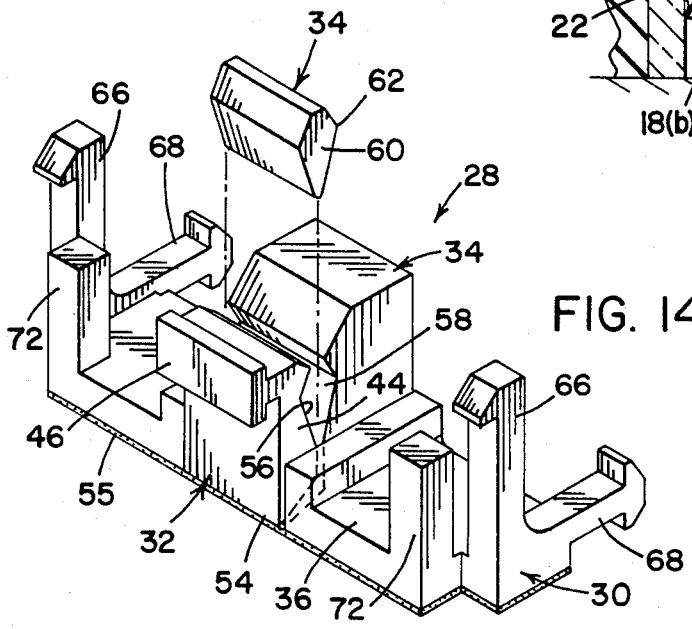
FIG. 14 is an enlarged, exploded, perspective view of the compression clip of FIG. 13

The embodiment illustrated in FIGS. 13 and 14 is similar to the embodiment of FIGS. 10–12, but the contact means 32 is integrally secured to the plate-like base 36 of the anchor means 30 by a thin component 54. Therefore, the adhesive layer 55 in this embodiment covers the entire bottom surface of the anchor means 30. Instead of employing an adhesive layer, screws and corresponding holes could be employed as disclosed with respect to the FIG. 7 embodiment.

The operation of the embodiment of FIGS. 13 and 14 is similar to that of FIGS. 10–12, except that when the wedge 60 is inserted between the faces 56 and 58, the wall member 44 pivots about the thin component 54 in a hinge-like manner, and is driven into the compression gasket 48.

Optionally, the plate-like base 36 of all the embodiments may include a pair of upper snap attachments 66 and a complimentary pair of lower snap attachments 68. The snap attachments 66 and 68 project outwardly from the plate-like base 36 and are generally positioned on each side of the wall member 42 of the adjustment means 34. Associated with the snap attachments 66 and 68 is an inverted L-shaped cross section cover member 70, as illustrated in FIGS. 1–4 to provide a pleasing aesthetic appearance by covering the compression clips 28. The inverted L-shaped cover member 70 can be made from metal or plastic and may include a painted coating or, if plastic is employed to make the L-shaped cover member, various color pigments can be incorporated therein so that the L-shaped cover member 70 is color-coordinated with the existing window frame 10.

Optionally, the plate-like based 36 may also include a pair of gasket guards 72 which extend perpendicularly from the plate-like base 36. The gasket guards are preferably positioned at each end of the compression clip 28 and close to the side of the compression clip 28 that is adjacent to or in contact with the compression gasket 18. The gasket guards 72 prevent the compression gasket 18 from bowing outwardly a predetermined excessive amount in the areas immediately adjacent to the contact means 32, when the gasket 18 is compressed. In this manner, a more uniform compression is obtained across the entire length of the compression gasket 18.

Thus, it is apparent that there has been provided, in accordance with the invention, a device that fully satisfies the aims and aspects setforth above. While the invention has been described in conjunction with specific embodiments thereof, it is evident that many alternatives, modification, and variations will be apparent to those skilled in the art in light of the foregoing description. Accordingly, it is intended to embrace all such alternatives, modifications, and variations as fall within the spirit and scope of the present invention.

What is claimed is:

1. A compression clip for maintaining a piece of glazing against a sealing strip to create with an existing window and window frame a dead air space between the window and the glazing, the compression clip comprising:

anchor means for anchoring the clip securely to the window frame, said anchoring means including a base plate having a first face for contacting said window frame, said first face having formed therein a recessed aperture, said base plate also including a second face, said second face having a projecting wall member;

contact means spaced away from and movable with respect to said anchoring means for compressing the piece of glazing against the sealing strip; and adjustment means for adjusting the space between said anchor means and said contact means by pushing said contact means away from said anchor means and against the piece of glazing, said recessed aperture slidably housing at least a poriton of said contact means and said wall member forming a poriton of said adjustment means.

2. The compression clip of claim 1, wherein said first face of said base plate includes an adhesive portion for securing said anchor means to the window frame.

3. The compression clip of claim 1, wherein said base palte includes at least two screws and at least two holes extending from said first face to said second face, whereby said screws extend through holes to secure said base plate to the window frame.

4. The compression clip of claim 1, wherein said contact means comprises an L-shaped part having an elongated arm and a perpendicular leg, at least a portion of said perpendicular leg sized so as to extend into said recessed aperture.

5. The compression clip of claim 4, wherein said adjustment means includes a wedge, said wedge capable of spacing said elongated arm from said wall member a predetermined distance.

6. The compression clip of claim 4, wherein said elongated arm includes a projection extending in a direction away from said wall member.

7. The compression clip of claim 1, wherein said adjustment means additionally includes a set screw, said wall member having a bore therethrough designed to secure said set screw in a rotative manner, said set screw being positioned in said bore and having sufficient length to butt against said contact means, thereby driving said contact means into said glazing upon rotation of said set screw.

8. The combination of a window frame and a compression clip for maintaining a piece of glazing against a sealing strip to create with an existing window and said window frame a dead air space between the window and the glazing, the compression clip comprising:

anchor menas for anchoring the clip securely to the window frame, said anchoring means including a base plate having a first face contacting said window frame, said first face having formed therein a recessed aperture, said base plate also including a second face, said second face having a projecting wall member;

contact means spaced away from and movable with respect to said anchoring means for compressing the piece of glazing against the sealing strip; and adjustment means for adjusting the space between said anchor means and said contact means by pushing said contact means away from said anchor means and against the piece of glazing, said recessed aperture slidably housing at least a portion of said contact means and said wall member forming a poriton of said adjustment means.

9. A system for creating dead air space between an exisitng window and window frame, and a piece of glazing, said system comprising:

a piece of glazing;

means to space said piece of glazing away from the existing window and to seal the space therebetween when said piece of glazing is properly compressed; and means to compress aid piece of glazing against said spacing means thereby forming a dead air space, said means to compress including a compression clip having anchor means for mounting said clip securely to said window frame, a contact means spaced away from and movable with respect to said anchor means for compressing said piece of glazing against said sealing strip, and an adjustment means for adjusting the space between said anchor means and said contact means by pushing said contact means away from said anchor means and against said piece of glazing; said means to compress further including a compression gasket mounted between said piece of glazing and said compression clip; said anchor means having a first face for contacting said window frame and a second face having a projecting wall member, said wall member forming a portion of said adjustment means.

10. The system of claim 9, wherein said first face includes a recessed aperture therein for slidably housing at least a portion of said contact means.

11. The system of claim 10, wherein said contact means includes an L-shaped part having an elongated arm and a perpendicular leg, at least a portion of said perpendicular leg sized so as to extend into said recessed aperture.

12. The system of claim 10, wherein said adjustment means includes a wedge, said wedge capable of spacing said wall member from said elongated arm a predetermined distance.

13. The system of claim 11, wherein said elongated arm includes a projection extending in a direction away from said wall member.

14. The system of claim 13, wherein said compression gasket includes a groove extending in a elongated direction said groove is designed to receive and mate with said projection on said elongated arm.

* * * * *

UNITED STATES PATENT AND TRADEMARK OFFICE

CERTIFICATE OF CORRECTION

PATENT NO. : 4,754,585

DATED : July 5, 1988

INVENTOR(S) : John R. Rundo

It is certified that error appears in the above-identified patent and that said Letters Patent is hereby corrected as shown below:

Column 7, line 68, "poriton" should read ---portion---.

Column 8, line 2, "poriton" should read ---portion---.

Column 8, line 7, "palte" should read ---plate---.

Column 8, line 36, "menas" should read ---means---.

Signed and Sealed this

Thirteenth Day of December, 1988

*Attest:*

DONALD J. QUIGG

*Attesting Officer*

*Commissioner of Patents and Trademarks*